United States Patent [19]

Ghosh

[11] 4,126,495

[45] Nov. 21, 1978

[54] NICKEL-BASE SUPERALLOY

[75] Inventor: Subrata Ghosh, Southfield, Mich.

[73] Assignee: Chrysler Corporation, Highland Park, Mich.

[21] Appl. No.: 786,730

[22] Filed: Apr. 11, 1977

Related U.S. Application Data

[63] Continuation-in-part of Ser. No. 386,894, Aug. 9, 1973.

[51] Int. Cl.[2] ..... C22C 19/05

[52] U.S. Cl. ..... 148/32; 75/171; 148/32.5

[58] Field of Search ..... 75/171, 170; 148/32, 148/32.5

[56] References Cited

U.S. PATENT DOCUMENTS

| | | | |
|---|---|---|---|
| 3,310,399 | 3/1967 | Baldwin | 75/171 |
| 3,617,685 | 11/1971 | Brill-Edwards | 75/171 |
| 3,744,996 | 7/1973 | Shaw et al. | 75/171 |

*Primary Examiner*—R. Dean

*Attorney, Agent, or Firm*—Baldwin & Newtson

[57] ABSTRACT

New nickel-base superalloys with good overall properties, the alloys being particularly adapted for high temperature applications at about 1800° F. to 2000° F., such as for turbine engine or other high temperature, high stress applications, and possessing a complex, multicomponent gamma prime $Ni_3Al_1$ matrix (not necessarily in the exact 3:1 proportion) in which both the nickel and aluminum atoms are partially replaced by, and/or containing, one or more of the following elements: Cr, Ti, Co, Mo and Ta. The nickel and aluminum may also be partially replaced by one or more of the following elements: W, C, Cb, Be, B, Zr and rare earths, such as for example, mischmetal. The gamma prime $Ni_3Al_1$ matrix phase precipitates a delta $Ni_1Al_1$ phase (not necessarily in the exact 1:1 proportion) at elevated temperatures (termed herein "inverse precipitation") thus providing critical high temperature strengthening of the matrix. Additionally, the alloy structure may contain a quantity of carbides, some borides and some nitrides.

4 Claims, No Drawings

NICKEL-BASE SUPERALLOY

BACKGROUND OF THE INVENTION

This application is a continuation-in-part of copending application Ser. No. 386,894, filed Aug. 9, 1973.

This invention relates to nickel-base high temperature superalloys particularly useful for applications at temperatures in the range of about 1800°–2000° F. but not restricted to these temperatures. The subject alloys, compared to the state-of-the-art superalloys such as IN-100 (AMS 5397), IN-713C (AMS 5371), Mar-M246, INCO 738 and others, have comparable or better high temperature properties, such as stress rupture life and the like, but contain relatively small amounts of expensive, strategic elements. Furthermore, the alloys are lower in raw material cost per pound and have a lower density than most of the state-of-the-art superalloys. Also, the property of "inverse precipitation" allows these alloys to be more readily machinable at room temperature than the state-of-the-art superalloys because the subject alloys exhibit their high strength only at high temperatures. In contrast, the commercial state-of-the-art superalloys possess exceptionally high strength at room temperatures so that the remnant strength at high temperatures is sufficient for the high temperature use. However, such alloys are usually difficult to machine and work at room temperature.

On the other hand, the subject alloys possess room temperature properties which are lower than comparable state-of-the-art superalloys because at room temperature the alloys of this invention possess a structure which is characterized by a matrix consisting essentially of $Ni_xAl_y$ wherein x varies between about 2.5 to 3.5 and y varies between about 0.75 to 1.25. At elevated temperatures, depending on the particular composition, a precipitate forms within the matrix comprised of $Ni_{x'}Al_{y'}$ wherein x' and y' both vary between about 0.75 to 1.25. Contrast this with the typical superalloy in which the structure consists of a gamma matrix, usually nickel solid solutions for example, and a precipitate of, for example, gamma prime i.e., $Ni_3Al_1$, present at lower temperatures in stable conditions but while gradually become unstable and tend to dissolve in the matrix at high temperatures. As a result, the subject alloys are usable up to 90% of their absolute melting temperature whereas the state-of-the-art superalloys' use is mostly restricted to about 75–80% of their absolute melting temperature.

The alloys of this invention partially replace nickel and/or aluminum with relatively small amounts of one or more of chromium, titanium, cobalt, molybdenum and tantalum, individually or in various combinations. Also, the alloys may contain small amounts of tungsten, columbium, carbon, boron, zirconium, rare earths such as mischmetal, and small amounts of beryllium. The structure at room temperature may show widespread carbides and may show occasional boride and nitride phases in a matrix of gamma prime ($Ni_xAl_y$) phase, depending on specific compositions.

SUMMARY OF THE INVENTION

It is, therefore, an object of this invention to provide a new high temperature superalloy. The alloy is one which is of ordinary strength at room temperature and is subject to normal handing procedure. Its strength reduction with temperature above the re-crystallization temperature is low as compared to other cast superalloys.

Moreover, the alloy of this invention exhibits dimensional stabiliy under stress at high temperature due to the inverse precipitation mecahnism so that it is useful for application in turbine engines, high temperaure dies, etc.

Furthermore, the alloy is oxidation and corrosion resistant, properties which are also very desirable in high temperature superalloys and may require no coating for most applications.

According to this invention, an alloy of the following nominal composition range, expressed in percentage weight*, is provided:

| | | |
|---|---|---|
| Aluminum | about | 6.75 – 10.00 |
| Chromium | " | 8.00 – 12.00** |
| Titanium | " | 0.80 – 2.50 |
| Cobalt | " | 2.00 – 6.00** |
| Molybdenum | " | 2.50 – 4.00 |
| Tantalum | " | 0.95 – 4.85 |
| Tungsten | " | 0 – 1.25 |
| Columbium | " | 0 – 0.60 |
| Carbon | " | 0 – 1.00** |
| Boron | – | 0 – 1.0** |
| Zirconium | " | 0 – 0.80 |
| Rare Earths | " | 0 – 1.0** |
| Beryllium | | 0 – 1.0** |
| Nickel (and incidental impurities) | | Balance |

The rare earth elements of this alloy are preferably added in the form known as mischmetal which is defined in the American Society for Metals handbook as an alloy of rare earth metals containing about 50% cerium with 50% of lanthanum neodymium and other similar rare earth elements. For the purpose of this invention, any of the rare earth metals may be used singly or in combination.

*Determined by chemical and spectographic analysis.

**These ranges are slightly broader than ideally desired since these constituents are difficult to control accurately from a practical standpoint. However, the broader range is that which would be insisted on by a commerical melter. Preferably, ranges are:

| | | |
|---|---|---|
| Cr | about | 9.00 – 11.00 |
| Co | " | 3.00 – 4.50 |
| C | " | 0.30 – 0.50 |
| B | " | 0.02 – 0.25 |
| Rare Earths | " | 0.02 – 0.05 |
| Be | " | 0 – 0.05 |
| Zr | " | 0.10 – 0.20 |

DESCRIPTION OF THE PREFERRED EMBODIMENTS

Included below are examples of specific alloys (Table 1) which fall within the composition range set forth above and pertinent properties thereof (Table 2).

TABLE 1

| Ex | Al | Cr | Ti | Co | Mo | Ta | W | Cb | C | B | Zr | Misch | Be | Ni |
|---|---|---|---|---|---|---|---|---|---|---|---|---|---|---|
| 1 | 6.75 | 9.70 | 1.84 | 3.53 | 2.99 | 2.00 | 0.50 | 0.25 | 0.50 | 0.05 | 0.09 | 0.02 | 0 | Bal |
| 2 | 10.01 | 10.29 | 1.59 | 2.7 | 2.7 | 1.8 | 0 | 0 | 0 | 0 | 0 | 0 | 0 | Bal |
| 3 | 9.11 | 9.26 | 1.83 | 3.46 | 2.93 | 1.85 | 0.49 | 0.24 | 0.29 | 0.06 | 0 | 0 | 0 | Bal |
| 4 | 7.82 | 10.47 | 1.82 | 3.45 | 2.92 | 1.95 | 0.50 | 0.24 | 0.49 | 0.05 | 0 | 0.02 | 0 | Bal |
| 5 | 9.21 | 9.35 | 0.82 | 3.49 | 2.96 | 1.86 | 0.49 | 0.25 | 0.30 | 0.06 | 0 | 0 | 0 | Bal |

TABLE 1-continued

| Ex | Al | Cr | Ti | Co | Mo | Ta | W | Cb | C | B | Zr | Misch | Be | Ni |
|---|---|---|---|---|---|---|---|---|---|---|---|---|---|---|
| 6 | 9.49 | 9.60 | 2.52 | 3.1 | 2.54 | 0.95 | 0 | 0 | 0 | 0.03 | 0 | 0 | 0 | Bal |
| 7 | 7.42 | 9.53 | 1.91 | 4.37 | 2.94 | 1.96 | 0.49 | 0.24 | 0.49 | 0.05 | 0.03 | 0.02 | 0 | Bal |
| 8 | 7.42 | 9.63 | 1.86 | 3.68 | 2.47 | 1.98 | 0.50 | 0.49 | 0.50 | 0.05 | 0.10 | 0.02 | 0 | Bal |
| 9 | 7.31 | 9.49 | 1.84 | 3.63 | 3.91 | 1.96 | 0.49 | 0.48 | 0.49 | 0.05 | 0.08 | 0.02 | 0 | Bal |
| 10 | 7.17 | 9.31 | 1.80 | 3.56 | 2.87 | 4.85 | 0.48 | 0.24 | 0.51 | 0.05 | 0.13 | 0.02 | 0 | Bal |
| 11 | 7.40 | 9.67 | 1.87 | 3.70 | 2.98 | 1.99 | 0 | 0.25 | 0.50 | 0.05 | 0.04 | 0.02 | 0 | Bal |
| 12 | 7.34 | 9.54 | 1.84 | 3.65 | 2.94 | 1.96 | 1.23 | 0.24 | 0.49 | 0.05 | 0.08 | 0.02 | 0 | Bal |
| 13 | 7.42 | 9.63 | 1.86 | 3.68 | 2.97 | 1.98 | 0.50 | 0 | 0.50 | 0.05 | 0.09 | 0.02 | 0 | Bal |
| 14 | 7.37 | 9.58 | 1.85 | 3.66 | 2.95 | 1.97 | 0.49 | 0.61 | 0.49 | 0.05 | 0.11 | 0.02 | 0 | Bal |
| 15 | 8.86 | 9.28 | 1.83 | 3.47 | 2.94 | 1.85 | 0.49 | 0.24 | 0.29 | 0.06 | 0 | 0 | 0 | Bal |
| 16 | 7.90 | 9.57 | 1.84 | 3.65 | 2.95 | 1.97 | 0.49 | 0.24 | 0.53 | 0.05 | 0.08 | 0.02 | 0 | Bal |
| 17 | 9.18 | 9.33 | 1.08 | 3.49 | 2.95 | 1.86 | 0.49 | 0.25 | 0.30 | 0.06 | 0 | 0 | 0 | Bal |
| 18 | 8.11 | 9.35 | 1.85 | 3.49 | 2.96 | 1.86 | 0.49 | 0.25 | 0.30 | 0.06 | 0 | 0 | 0 | Bal |
| 19 | 7.39 | 9.53 | 1.86 | 3.64 | 3.41 | 1.97 | 0.73 | 0.49 | 0.50 | 0.05 | 0.80 | 0.02 | 0 | Bal |
| 20 | 8.36 | 9.33 | 1.84 | 3.49 | 2.95 | 1.86 | 0.49 | 0.25 | 0.30 | 0.06 | 0 | 0 | 0 | Bal |
| 21 | 7.30 | 9.48 | 1.83 | 3.62 | 3.90 | 2.22 | 0.49 | 0.48 | 0.49 | 0.05 | 0.06 | 0.02 | 0.05 | Bal |
| 22 | 7.23 | 9.43 | 1.86 | 3.78 | 3.64 | 2.21 | 0.73 | 0.43 | 0.49 | 0.05 | 0.20 | 0.02 | 0 | Bal |
| 23 | 7.38 | 9.59 | 1.85 | 3.67 | 2.96 | 1.97 | 0.49 | 0.49 | 0.50 | 0.05 | 0.07 | 0.02 | 0.05 | Bal |

Table 2

| | Tensile Properties UTS, 0.2% Y.S. % EL | | Stress Rupture Properties (HRS. % EL) at $10^{2\circ}$ F/KPSI | | | | | | | | | | | |
|---|---|---|---|---|---|---|---|---|---|---|---|---|---|---|
| Ex. | RT | 1800° F | 15/25 | 15/30 | 17/20 | 18/20 | 18/15 | 19/10 | 18/30 | 18/25 | 19/15 | 20/10 | 20/12.5 | 20/7.5 |
| 1. | 112-91-4 | 64-61-3 | — | — | — | 218-11 | — | — | 16-5 | 59-6 | 92-10 | 70-8 | 14-11 | — |
| 2. | 117-111-2 | 44-41-3 | 252-3 | 102-3 | — | — | — | — | — | — | — | — | — | — |
| 3. | 108-102-2 | 55-49-2 | — | — | 99-3 | — | 51-5.0 | 64-13 | — | — | — | — | — | — |
| 4. | 96-95-2 | 58-56-2 | — | — | — | 86-5 | 331-4 | — | — | — | 41-4 | — | — | 160-3 |
| 5. | 112-93-4 | 52-52-1 | — | — | 73-7 | 23-8 | 75-5 | 93-6 | — | — | — | — | — | — |
| 6. | 109-95-3 | 65-63-2 | 1837-2 | 1001-2 | — | — | — | — | — | — | — | — | — | — |
| 7. | 109-102-4 | 72-69-6 | — | — | — | 119-5 | — | — | 17-6 | 48-4 | | | | |
| 8. | 107-99-3 | 71-68-4 | — | — | — | 187-7 | — | — | 17-5 | 44-4 | 101-14 | 86-10 | 22-12 | — |
| 9. | 118-103-5 | 72-70-8 | — | — | — | 250-7 | — | — | — | 56-18 | — | 113-4 | 33-5 | — |
| 10. | — | — | — | — | — | — | — | — | 5-3 | — | — | — | — | — |
| 11. | 114-100-4 | 73-71-5 | — | — | — | 103-8 | — | — | 20-10 | 52-10 | — | 54-3 | 22-5 | — |
| 12. | — | — | — | — | — | — | — | — | — | — | — | 27-5 | — | — |
| 13. | 110-95-4 | — | — | — | — | 211-8 | — | — | — | 79-11 | 65-5 | 113-5 | 31-7 | — |
| 14. | 114-98-9 | 69-66-4 | — | — | — | 173-8 | — | — | 22-8 | 69-11 | 90-6 | 96-10 | 27-8 | — |
| 15. | 98-98 | 63-63-1 | — | — | 71-3 | 15-3 | 74-3 | 40-2 | — | — | — | — | — | — |
| 16. | 100-78-5 | 56-53-4 | — | — | — | 137-8 | — | — | 20-9 | 54-9 | 102-6 | 76-4 | — | 320-3 |
| 17. | 121-110-3 | 63-52-3 | — | — | 151-8 | 27-5 | 82-5 | 43-4 | — | — | — | — | — | — |
| 18. | 114-92-7 | 69-65-3 | — | — | 318-5 | 48-3 | 143-2 | 176-2 | — | — | — | — | — | — |
| 19. | 114-102-4 | — | — | — | — | 264-10 | — | — | — | — | — | — | — | — |
| 20. | 118-102-7 | 67-64-3 | — | — | 470-7 | | 62-5 | 211-5 | — | — | — | — | — | — |
| 21. | 117-102-5 | 75-73-4 | — | — | — | 213-7 | — | — | 17-7 | 50-5 | 107-5 | 108-5 | 23-8 | |
| 22. | 113-101-4 | 70-67-3 | — | — | — | 269-6 | — | — | — | — | — | 195-8 | 10-12 | — |
| 23. | 118-102-4 | 71-68-6 | — | — | — | 134-9 | — | — | — | 38-4 | 86-6 | — | — | — |

A preferred nominal composition, expressed in percentage weights is as follows, about:

| | |
|---|---|
| Aluminum | 7.10 - 7.89 |
| Chromium | 9.45 - 9.65 |
| Titanium | 1.83 - 1.94 |
| Cobalt | 3.49 - 4.00 |
| Molybdenum | 2.95 - 3.90 |
| Tantalum | 1.97 - 2.22 |
| Tungsten | 0.49 - 0.73 |
| Columbium | 0.24 - 0.49 |
| Carbon | 0.30 - 0.60 |
| Boron | 0.05 |
| Zirconium | 0.10 - 0.20 |
| Rare Earths | 0.02- 0.05 |
| Nickel (and incidental impurities) | the Balance |

A preferred nominal composition, expressed in percentage weight, is as follows:

| | | |
|---|---|---|
| Aluminum | about | 7.5 |
| Chromium | " | 9.5 |
| Titanium | " | 1.8 |
| Cobalt | " | 3.5 |
| Molybdenum | " | 3.5 |
| Tantalum | " | 2.0 |
| Tungsten | " | 0.7 |
| Columbium | " | 0.04 |
| Carbon | " | 0.5 |
| Boron | " | 0.05 |
| Zirconium | " | 0.20 |
| Rare Earths | " | 0.02 |
| Nickel (and incidental impurities) | Balance | |

The following examples in Table 3 are typical compositions prepared with the accuracy available using state-of-the-art preparation procedures and within practical limits with the above preferred composition as a target. Table 4 contains various properties of most of the examples shown in Table 3.

TABLE 3

| | Ex. 1 | Ex. 2 | Ex. 3 | Ex. 4 | Ex.5 | Ex.6 | Ex. 7 | Ex. 8 | Ex. 9 | Ex. 10 |
|---|---|---|---|---|---|---|---|---|---|---|
| Al | 7.41 | 7.45 | 7.30 | 7.23 | 7.38 | 7.38 | 7.43 | 7.10 | 7.89 | 7.37 |
| Cr | 9.60 | 9.57 | 9.48 | 9.45 | 9.51 | 9.58 | 9.62 | 9.65 | 9.57 | 9.58 |
| Ti | 1.85 | 1.92 | 1.83 | 1.86 | 1.86 | 1.85 | 1.85 | 1.94 | 1.84 | 1.85 |
| Co | 3.67 | 4.0 | 3.62 | 3.78 | 3.63 | 3.68 | 3.51 | 3.51 | 3.49 | 3.66 |
| Mo | 2.96 | 2.95 | 3.90 | 3.64 | 3.42 | 2.95 | 2.97 | 2.97 | 2.95 | 2.95 |
| Ta | 1.98 | 1.97 | 2.22 | 2.21 | 2.22 | 1.97 | 1.98 | 1.99 | 1.97 | 1.97 |
| W | 0.49 | 0.49 | 0.49 | 0.73 | 0.73 | 0.49 | 0.50 | 0.50 | 0.49 | 0.49 |
| Cb | 0.25 | 0.24 | 0.48 | 0.48 | 0.49 | 0.49 | 0.25 | 0.25 | 0.24 | 0.61 |
| C | 0.50 | 0.49 | 0.49 | 0.49 | 0.50 | 0.50 | 0.50 | 0.50 | 0.49 | 0.49 |
| B | 0.05 | 0.05 | 0.05 | 0.05 | 0.05 | 0.05 | 0.05 | 0.05 | 0.05 | 0.05 |

TABLE 3-continued

| | Ex. 1 | Ex. 2 | Ex. 3 | Ex. 4 | Ex.5 | Ex.6 | Ex. 7 | Ex. 8 | Ex. 9 | Ex. 10 |
|---|---|---|---|---|---|---|---|---|---|---|
| Zr | 0.14 | 0.10 | 0.10 | 0.17 | 0.15 | 0.11 | 0.13 | 0.14 | 0.17 | 0.11 |
| Misch | 0.02 | 0.02 | 0.02 | 0.02 | 0.02 | 0.02 | 0.02 | 0.02 | 0.02 | 0.02 |
| Ni* | | | | | | Balance | | | | |

*including incidental impurities

TABLE 4

Following are the properties which have been obtained as a result of the application of standard tests to some of the "as cast" alloys listed in Table 3 as examples:

| | *Tensile Properties UTS, 0.2% Y.S. % EL** | | Hardness | Stress Rupture Properties (HRS. % EL)** at $10^2$ ° F/KPSI | | | | | | |
|---|---|---|---|---|---|---|---|---|---|---|
| | R.T. | 1800° F. | $R_c$ | 18/30 | 18/25 | 18/20 | 19/15 | 20/10 | 20/7.5 | 20/12. |
| Ex. 1 | 108,93,6 | 62,60,4 | 29–33 | 23–7 | 87–11 | 218–10 | 148–7 | 136–8 | 544–12 | — |
| Ex. 2 | 115,95,7 | 74,70,5 | 31–34 | 40–7 | 63–14 | 254–8 | — | 121–3* | 263–3* | — |
| Ex. 3 | 117,102,5 | 75,73,4 | 30–34 | 17–7 | 50–5 | 213–7 | 107–5 | 108–5 | — | 23–8 |
| Ex. 4 | 119,105,4 | 72,68,4 | 30–35 | 25–8 | 77–7 | 187–5 | 191–10 | 195–8 | — | 18–6 |
| Ex. 5 | 110,99,4 | — | 31–34 | — | 63–9 | 229–7 | 122–6 | 195–7 | — | 28–4 |
| Ex. 6 | 116,100,8 | 70,68,7 | 32–36 | 26–8 | 78–7 | 251–10 | 142–15 | 115–5* | — | 33–9 |
| Ex. 7 | 107,93,4 | 67,64,8 | 30–35 | 25–8 | 64–15 | 305–13 | 126–19 | 137–7 | 857–4 | — |
| Ex. 8 | 107,99,4 | 70,69,4 | 29–35 | 25–14 | 80–9 | 302–8 | 162–8 | 102–7 | 456–9 | — |
| Ex. 9 | 101,92,4 | 72,70,4 | 31–36 | 18–6 | 50–6 | 167–12 | 103–8 | 158–13 | 706–13 | — |

*These samples showed signs of defects in failed section.
**% EL measured on 4D gage length

ALLOY PREPARATION

All of the alloy examples were made by induction melting in a vacuum chamber and vacuum cast. Essentially, the raw materials were charged in an induction melting crucible and vacuum pumped until the inside pressure stabilized to a value between 10 and 100 microns at which time the heating began. The aluminum in the charge melted first, formed a pool at the bottom of the crucible and dissolved the rest of the charge within a short period. From this "all molten" condition, the alloy was superheated to 3200° F. within a controlled period of 10 minutes. A five minute holding period at 3200° F. was then followed by cooling to 3050° F. Some additions, such as boron and mischmetal were made at this time and the alloys poured out immediately inside the vacuum chamber in a preheated (between 1550°–1650° F.) thin-shell silica investment mold. When the metal solidified in the mold (in about 8 minutes), the vacuum of the chamber was broken and the test-bar casting was taken out and cooled in air.

What is claimed is:

1. An alloy having a nominal composition consisting essentially of the following constituents in about the stated weight percentages:

| | |
|---|---|
| Aluminum | 6.75–10.00 |
| Chromium | 8.0–12.00 |
| Titanium | 0.80–2.50 |

-continued

| | |
|---|---|
| Cobalt | 2.00–6.00 |
| Molybdenum | 2.50–4.00 |
| Tantalum | 0.95–4.85 |
| Tungsten | 0–1.25 |
| Columbium | 0–0.60 |
| Carbon | 0–1.00 |
| Boron | 0–1.00 |
| Zirconium | 0–0.80 |
| Rare Earths | 0–1.00 |
| Beryllium | 0–1.0 |

Nickel (including incidental impurities) the Balance, and wherein the alloy is particularly characterized by a room temperature gamma prime type of matrix and by the formation of a delta NiAl type of precipitate within the matrix at elevated temperatures.

2. An alloy according to claim 1 wherein:
the Zirconium percentage range is about 0.10–0.20,
the Rare Earths percentage range is about 0.02–0.05, and
the Beryllium percentage range is about 0–0.05.

3. An alloy according to claim 1 wherein:
the Boron percentage range is about 0.02–1.00.

4. An alloy according to claim 1 wherein:
the Chromium percentage range is about 9.00–11.00,
the Cobalt percentage range is about 3.00–4.50,
the Carbon percentage range is about 0.30–0.50,
the Boron percentage range is about 0.02–1.00,
the Rare Earths percentage range is about 0.02–0.05, and
the Beryllium percentage range is about 0–0.05.

* * * * *